United States Patent [19]

Fairbanks, Jr. et al.

[11] 3,951,749

[45] Apr. 20, 1976

[54] TAR SAND PROCESSING APPARATUS

[76] Inventors: John B. Fairbanks, Jr., 3927 S. 3030 East, Salt Lake City, Utah 84106; Gary C. Brimhall, 2915 Branch Drive, Salt Lake City, Utah 84117

[22] Filed: Apr. 19, 1974

[21] Appl. No.: 462,346

[52] U.S. Cl. ..... 196/46; 23/267 S; 23/270 B; 134/25 R; 196/14.52; 208/11 R

[51] Int. Cl.[2] ..... C10C 1/20; C10G 1/00; C10G 1/04

[58] Field of Search ..... 196/14.52, 46; 23/267 S, 270 B; 208/11; 134/25 R

[56] References Cited

UNITED STATES PATENTS

| | | | |
|---|---|---|---|
| 701,239 | 5/1902 | Wood | 23/270 B |
| 918,629 | 4/1909 | Willis | 196/14.52 |
| 1,317,625 | 9/1919 | Huff | 23/267 S |
| 2,581,175 | 1/1952 | De La Calle | 23/270 B X |
| 2,980,600 | 4/1961 | Kelley | 196/46 X |
| 3,117,922 | 1/1964 | Leary et al. | 196/14.52 X |
| 3,156,248 | 11/1964 | Rand | 134/25 R X |
| 3,222,221 | 12/1965 | Branson | 134/25 R X |
| 3,275,472 | 9/1966 | Tontawi et al. | 23/280 B X |
| 3,605,975 | 9/1971 | Brimhall | 196/46 X |

FOREIGN PATENTS OR APPLICATIONS

| | | | |
|---|---|---|---|
| 484,740 | 7/1952 | Canada | 134/25 R |
| 419,053 | 2/1933 | United Kingdom | 196/46 |

*Primary Examiner*—Barry S. Richman

[57] ABSTRACT

Apparatus for processing tar sands to recover bitumen therefrom, and without the use of heat of steam, such apparatus including a processing tank having a concave, upwardly facing bottom constructed for receiving the upper flight of an endless conveyor thereat. Structure is provided for admitting tar sands onto the feed end of such conveyor and for discharging the same at the discharge end thereof. Stirrer means are provided as needed, above the endless conveyor, for maintaining in solution the very fine tar sand particles, this to effect as efficient a recovery of oil therefrom as possible. A baffle is constructed to separate recovered oil, disposed as a layer over the aqueous bath of the tank, from the discharge end of the tank and the spent sands coming upwardly thereat. In one embodiment the processing tank is constructed for towing by a vehicle and, in another embodiment, the bottom of the tank is constructed to separately contain diluent for pre-processing the tar sands to be fed into the main tank proper.

10 Claims, 10 Drawing Figures

TAR SAND PROCESSING APPARATUS

The present invention relates to apparatus for processing tar sands, and without the use of heat or steam, to recover oil or bitumen therefrom and, more particularly, to new and improved apparatus accommodating both feed, transverse travel and discharge of tar sands through a predetermined aqueous bath. The tank bottom is concave, upwardly facing, and is constructed such that an endless conveyor in the form of a series of parallel bars, spacers, or buckets, can be used to receive tar sands at the feed end of the tank and discharge spent sands at the discharge end thereof.

Stirrer means are provided in the manner shown for effecting a maximum recovery of oil from sands, particularly small particulate sands as may be suspended above the conveyor in the solution at intermediate areas within the tank structure.

In one embodiment the tank is provided with wheels so as to provide for convenient mobility and transfer of the tank structure relative to tar sand sites to which the tank is to be used.

In another embodiment the tank includes a separated diluent receiving tank portion wherein the sands are preliminary introduced into such tank portion preparatory to discharge therefrom and entrance into the primary tank region containing the aqueous bath.

While the tar sands are premixed with a diluent, then a single upwardly facing cavity in the tank will be sufficient for processing the sands. Where the tank proper is to include an initial aqueous bath, the initial bath region is preferably separated from the primary bath portion of the tank structure.

It is possible that, in the first instance, the tank may include a diluent layer disposed above and carried by the aqueous bath of the tank, this to ensure an initial if momentary premixture of the diluent with the tar sands preparatory to their entrace into the tank.

As to the diluent that may be used, the same may comprise one of the following by way of example: naptha, regular gasoline, diesel oil, kerosene, stove oil, and so forth. Lighter diluent such as naptha and regular gasoline are preferred since much less is needed of these lighter fractions and, furthermore, these will tend to process the sands in the sense of diluting the bitumen therein to a less viscuous form, in substantially less time.

As to the aqueous bath itself, the same may be provided with a specific gravity raising salt, which is soda ash, and also a wetting agent such as sodium silicate.

The present invention, however, is related to the structure of the apparatus by which the tar sands are processed so as to effect a maximum recovery of bitumen from tar sands introduced within the structure.

Accordingly, a principal object of the present invention is to provide new and improved apparatus for processing tar sands, and without the use of heat or steam, to effect maximum bitumen recovery therefrom.

A further object is to provide tar-sand processing apparatus which is transportable.

An additional object is to provide apparatus for processing tar sand wherein the sands can be advanced by an endless conveyor in a continuous manner from a feed end to a discharge end of the structure, and this such as to effect maximum recovery of the bitumen from the tar sands.

An additional object is to provide an endless conveyor in the form of a drag line, whereby the endless conveyor, in the form preferably of upstanding bars, rods, or buckets, may advance the sands within and proximate the bottom of a processing tank, this so that minimum supporting structure for the endless conveyor will be needed when such is disposed in the interior or such tank.

An additional object is to provide baffle means within a tar sand processing tank, this to keep recovered oil and possibly diluent from mixing with the spent sands as the same are advanced upwardly at the discharge end of the tank.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

in FIG. 5 is illustrated a conventional means by which the endless conveyor is supported and is revolved at its ends.

in FIG. 7 the structure is also made portable so as to be capable of being hauled by a vehicle.

Figures 1, 2, 3, 4, 5, 6:
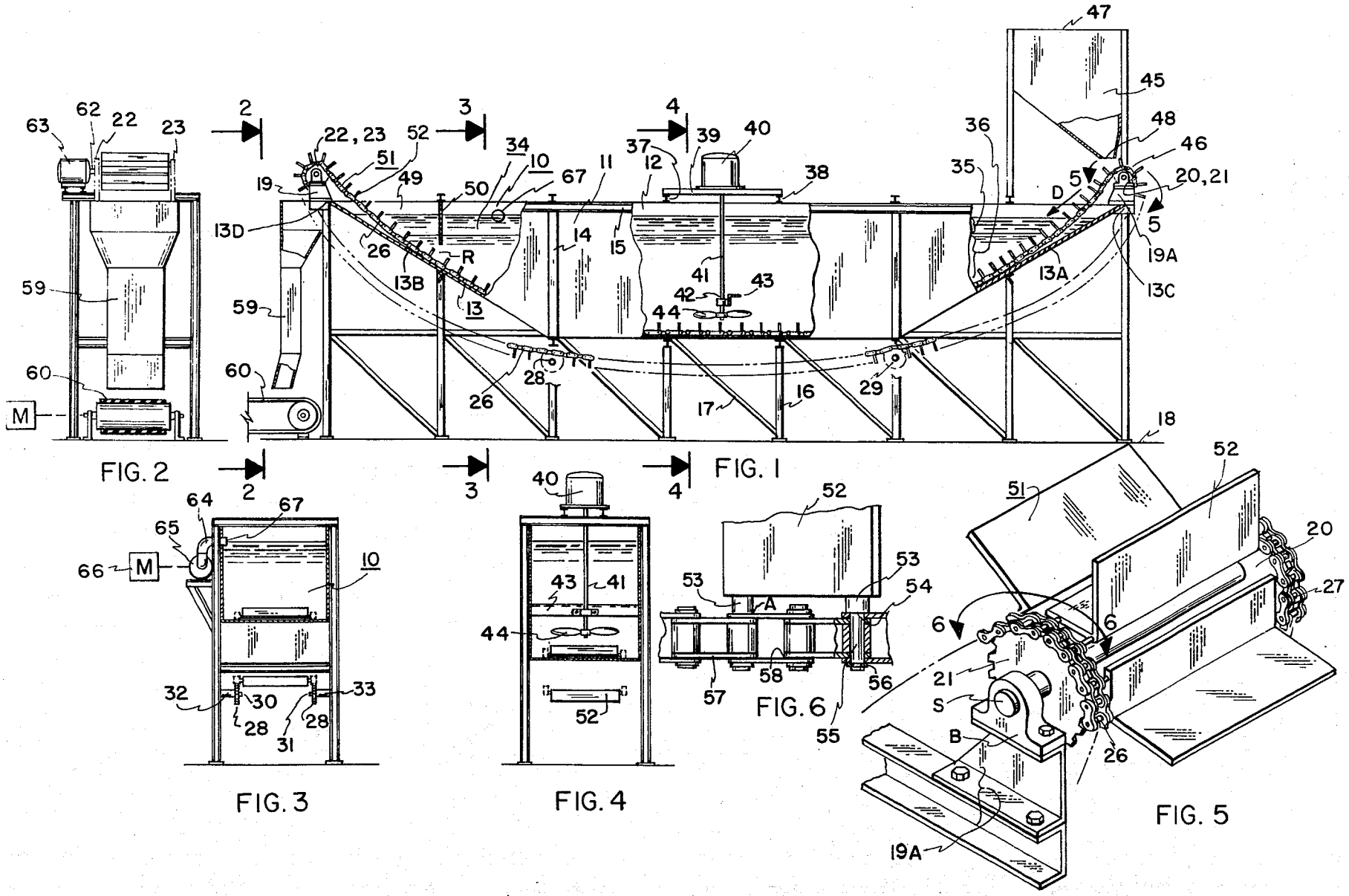
FIG. 1 is a side elevation, partially broken away, of a processing tank showing one form of the invention.
FIG. 2 is an end elevation of the left end of the structure shown in FIG. 1.
FIG. 3 is a transverse vertical cross-section taken along the line 3—3 in FIG. 1.
FIG. 4 is a transverse vertical cross-section taken along the line 4—4 in FIG. 1.
FIG. 5 is an enlarged perspective view of one of the respective ends of the structure as taken along the line 5—5 in FIG. 1.
FIG. 6 is a fragmentary top plan of a respective portion of the conveyor of the present invention.

In FIG. 1, tank 10 includes a pair of sides 11 and 12, also a concave, upwardly facing, dog-leg bottom 13 said discharge and feed ends being disposed in mutual alignment with said endless conveyor. Sufficient structure at 14 and 15 on opposite sides of the tank 10 are provided to add structural rigidity to the same, and support means in a form of supports 16 and bracing 17 are integrally provided to support the tank from a common support plane 18.

Structural means 19 and 19A comprise end sprocket mounts including the sprockets 20 and 21 and also 22 and 23 at opposite ends of the tank. These sprockets will be keyed to respective common shafts S, see FIG. 5, that are in turn supported by the structures 19 and 19A including bearings B.

Engaging the sprockets are a pair of flexible endless members comprising endless sprocket chains 26 and 27 that mesh with sprockets 20-23 in the manner indicated in FIGS. 1 and 5. These endless chains pass over respective idler rollers or sprockets 28 and 29 as is seen also in FIGS. 1 and 3. These sprockets are journaled by their respective shafts 30 and 31 which are mounted in place by coaxial bosses 32 and 33. The particular means of attachment of the idler sprockets forms no part of the present invention.

The tank 10 thus has an aqueous-bath receiving interior 34, the same permissably, in one form of operation, including an upper diluent layer 35 and also a lower aqueous solution zone 36.

I-beams 37 and 38 span the tank and support a plate 39 upon which motor 40 is mounted. Motor 40 includes a central shaft 41 which is journaled by bearing 42 as carried by crossbar 43. The latter is affixed at its ends to opposite sides of the tank. A stirrer 44 may take the form of a propeller or impeller and is keyed to shaft 41. Hopper 45 is fixedly mounted proximate the feed end 46 of the tank and includes a mouth 47 and also a discharge opening 48. The discharge end 49 of the tank is provided with a transverse baffle 50 which is fastened at its ends to the tank sides.

It is noted that there is sufficient space R between the lower extremity of the baffle and the floor 13 of the tank to permit the passage of the endless conveyor. The endless conveyor 51 itself includes a series of conveyor drag elements, buckets or bars 52 having, at opposite ends thereof, protruding stub connectors 53. Each of the stub connectors may comprise a shaft provided with a shoulder 54 and also a pin portion 55 provided with retainer 56. Thus, the several pin portions may actually be received by employing the apertures A of adjacent links 57 and 58.

Chute structure 59 is provided proximate the discharge end 49 of the tank and receives spent tar sand materials to discharge the same onto endless conveyor 60. The endless conveyor 51 itself may be driven by a common shaft 62 that is powered by motor 63. The shaft 62 is pinned to the opposite sprockets 22 and 23. Conduit 64 communicates with the interior of the tank 10 and includes a pump 65, powered by a motor 66, the combination of which serves to pump the fluid recovered to any desired location. This fluid may comprise simply recovered oil, diluent plus oil, or oil plus a slight degree of water which, upon subsequent processing, may be separated by centrifuge or any other known dewatering technique.

The structure above described in FIGS. 1-6 operates as follows. Tar sands are introduced into the mouth 47 of hopper 45 and are discharged at opening 48 onto the endless conveyor 51. This endless conveyor, again, comprises a pair of endless, opposite side sprocket chains upper portions of which may be effectively dragged along the bottom 13 of tank 10. The sprocket chains of the endless conveyor are supported by idler sprockets 28 and 29 and, of course, by the end sprockets 22, 23 and also 21,21. The upper portions of the sprockets are purposely loose so that the conveyor bars or tar sand drag bars or drag elements, as they may be termed, will be disposed proximate the bottom of the tank. Accordingly, the tar sands gradually introduced into the conveyor will proceed in the direction of arrow D such that the material is dragged on the bottom of the tank and comes upwardly underneath baffle 50 and over the sprockets at 22 and 23 such that the spent tar sand falls into chute 59. The aqueous solution zone 36 will include a specific gravity-raising salt and also a wetting agent, so as to accelerate freed droplets of oil upwardly. Either the tar sands are preliminarily mixed with a diluent, so as to reduce the viscosity of the bitumen surrounding the sand particles, or a diluent layer 35 is provided. In either event, the tar sands coming into the aqueous solution comprise a preliminary admixture with diluent so that the now less-viscuous bitumen can have the ability to float rapidly upwardly to the top surface. Oil or diluent plus oil is recovered at orifice 67, see also FIG. 3, so that the recovered oil may be pumped into external refinery apparatus, as desired, for further processing.

The motor 40 will rotationally actuate a stirrer 44 so that, if desired, the oil may be freed as much as possible from the descending sand particles, further, so that the sand may remain in suspension as long as possible as to minor sized particles.

Figure 7:
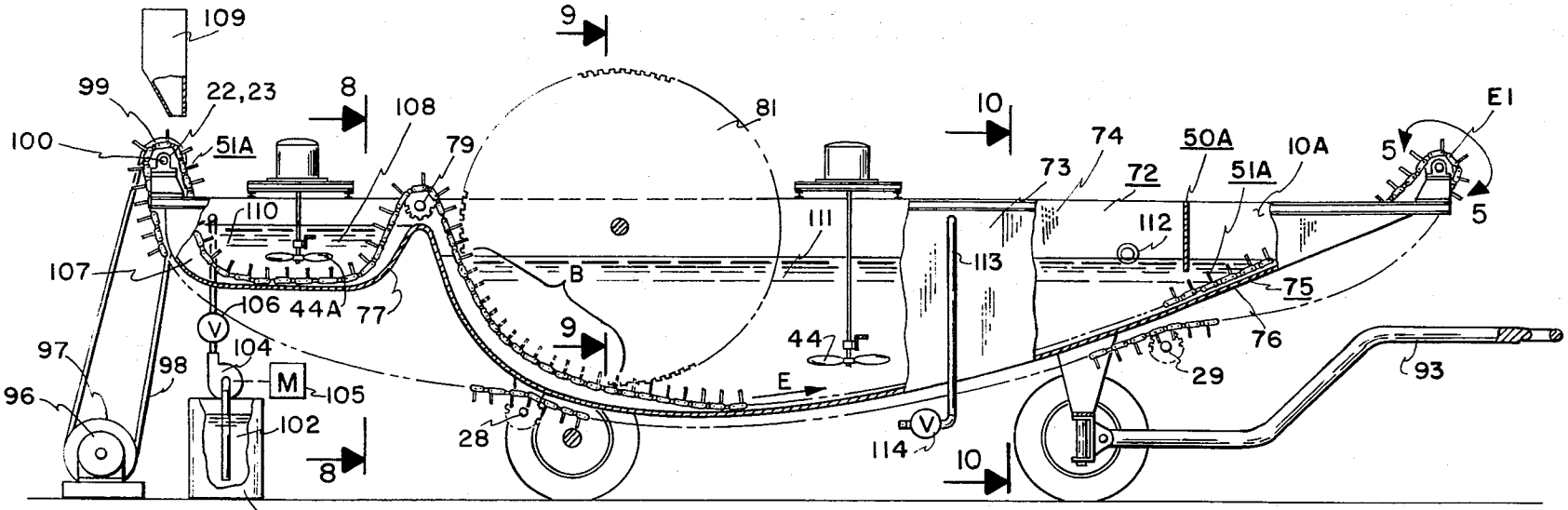
FIG. 7 is a side elevation, similar to FIG. 1, that illustrates the tank apparatus having a diluent chamber in combination with an aqueous bath chamber.
Figure 10:
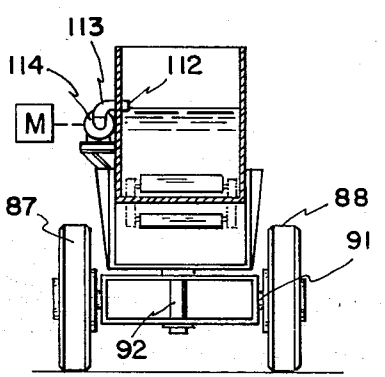
FIG. 10 is a horizontal vertical section taken along the line 10—10 in FIG. 7 and showing the front wheel journaling structure.
Figure 9:
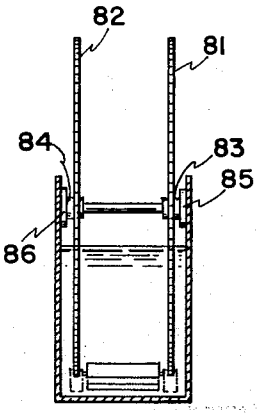
FIG. 9 is likewise a transverse vertical section taken along the line 9—9 in FIG. 7.
Figure 8:
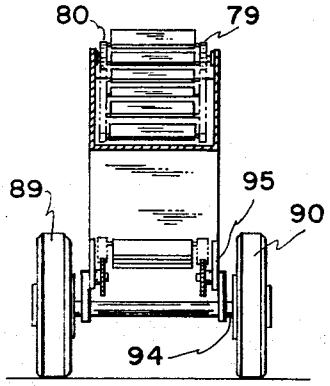
FIG. 8 is a transverse vertical section taken along the line 8—8 in FIG. 7.

FIG. 7 illustrates an alternate form of tank which is constructed to be carried upon wheels and, hence, be conveniently transportable. The tank 72 includes a pair of sides 73 and 74 and also a bottom 75 comprising a major bottom portion 76 and also a minor bottom portion 77. Sprockets 20-23 are again provided, see FIGS. 1 and 5 as well, and of course idler sprockets 28 and 29 as in FIG. 1. Additional idler sprockets 79 and 80 are provided and are journaled by their respective shafts or pins to the sides of the tank. Of interest, the large sprocket wheels 81 and 82 which are keyed to stub shafts 83 and 84, the latter having flanged mounts 85 and 86. These may comprise means for constraining the portion B of each endless link chain proximate the major bottom portion 76. The chain and endless conveyor structure 10A, corresponding to endless conveyor 10 in FIG. 1, may be constructed in a similar manner. It will be noted that in lieu of angle-formed conveyor bars, there may be used T-sections, buckets, scoops or any other type of configuration tending to drag or otherwise convey across the bottom of the tank the tar sands introduced into the tank.

The tank 72 is itself supported by wheels 87-90. Wheels 87,88 may be independently journaled on a common axis, biaxle 91 which is carried by a pivot post or journal 92. Tongue 93 is constructed for connection to an external factor such as a truck or other vehicle. The impeller 44 with its structure may be provided as in the embodiment of FIG. 1. Wheels 89 and 90 are journaled for corresponding or independent rotation relative to their axle 94, and the latter is supported by structure 95 relative to the tank 72. Motor 96 includes a drive pulley 97 and a V-belt drive 98 that engages driven pulley 99 pinned to shaft 100. To shaft 100 may be pinned the sprockets 22 and 23 which drive the endless conveyor 51A. Diluent at 102 may be contained in the tank 103 and pumped by pump 104 and motor 105 through check valve 106 to inlet orifice 107 of the diluent tank portion on hopper 109, provided to receive tar sands which are to be dropped directly into the diluent 110. The tar sands are mixed at 110 with the diluent and proceed upwardly via the endless conveyor 51A upwardly out of the diluent and then down into the aqueous bath 111. This aqueous bath includes a specific gravity-raising salt and also a wetting agent. Recovery of the oil may be made through orifice 112 that forms the inlet of conduit 113 leading to pump 114.

The structure as above described in FIGS. 7-10 operates as follows. At the outset, it is seen that the structure shown is constructed for towing by tractor or other vehicle to a desired site. When this place is reached appropriate blocking of the wheels is made, power is applied the respective motors, and the structures of the apparatus is ready for operation. Tar sands are introduced into hopper 109 to fall onto the endless conveyor which moves in the direction E as shown by the arrow in FIG. 7. The initial, leftward, upper course of conveyor 51A thus receives the tar sands and permits their conveyance in a direction from left to right underneath the stirrer 44A. The latter will be similar to stirrer 44 which its structure to the right of the large sprocket wheels 81. In any event, the tar sands are conveyed to the left, underneath the stirrer and over the sprockets 79, so as to withdraw these tar sands from the diluent. The now soaked tar sands are introduced directly into the aqueous solution at 111, with sprocket wheels 81 serving to force the portions B of the opposed sprocket chains downwardly, so as to be in proximity with the bottom of the tank. Thus, the general contour of the tank is followed by conveyor 51A, so that the tar sands are gradually brought underneath the impeller 44. Both impellers or stirrers, if employed, will serve to stir slightly any small tar sands so as to keep the same in solution to effect a rapid recovery. The tar sands are advanced upwardly past the depending baffle 50A, corresponding to baffle 50 in FIG. 1, so that the tar sands may be expelled from the conveyor discharge end at E1.

Conduit 113 is provided and check valve 114 is included, for coupling to a water source so that the predetermined water level may be preserved as desired.

The structure shown at the lower left of FIG. 7, with its connections, may be conveniently carried by a truck or tractor and then, when the work site has been reached, such equipment will be removed from the carrier and installed or otherwise positioned as shown in FIG. 7.

The process for which the present apparatus is used is fully disclosed in the inventors' co-pending patent application entitled PROCESS AND FLUID MEDIA FOR TREATMENT OF TAR SANDS TO RECOVER OIL, executed by the inventors on Apr. 10, 1974, Ser. No. 462,206 filed Apr. 19, 1974, which application is fully incorporated herein by way of reference.

What is provided therefore in the structure of FIGS. 7–10 is certain tank structure for processing tar sands, wherein the tar sands are first introduced into and then withdrawn from a diluent bath, and subsequently introduced slowly into an aqueous bath conditioned in the manner to dilute and rapidly separate the now dilute bitumen from tar sand particles so as to allow the former to bubble upwardly and the latter to fall downwardly as sludge. If desired, a suitable clean-out port may be provided at the bottom of the large tank.

This invention thus provides, in the aggregate, structure for processing tar sands, without the use of heat or steam, so as to effect a maximum clean recovery of oil or bitumen from such tar sands.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

We claim:

1. Apparatus for processing tar sands to recover oil therefrom, said apparatus including, in combination: a tank having an upward facing concave bottom provided with upwardly and outwardly sloping, opposite end portions respectively terminating in discharge and feed ends; an endless conveyor having an upper course descending into said tank, being positioned therein against said bottom, and a lower course disposed underneath said tank, having upwardly and outwardly sloping opposite end portions 13A and 13B terminating in feed and discharge ends 13C and 13D; said endless conveyor comprising a pair of mutually horizontally spaced, flexible, endless members and plural, mutually spaced, transverse, drag elements affixed to, upstanding from said upper course, and carried by said flexible endless members; means for feeding tar sand to said feed end of said tank for engagement thereat with the upper course of said endless conveyor; means for discharging processed tar sand from the discharge end of said tank; and means for supporting and powering said endless conveyor coupled thereto.

2. The apparatus of claim 1 wherein said flexible endless members comprise endless link chains, said drag elements comprising rigid elongate angles secured to and between said endless link chains.

3. The structure of claim 1 wherein said flexible endless members comprise link chains, said apparatus including sprockets journaled above said discharge and feed ends and carrying said link chains.

4. The structure of claim 1 wherein said tank includes wheel supports and also a longitudinally extending draw-bar tongue.

5. The structure of claim 1 wherein said flexible endless members comprises link chains, said tank including interior, journaled sprocket means disposed above said upper course and engaging said link chains for constraining the latter to proximity with the inner contour of said tank.

6. The apparatus of claim 1 wherein said flexible endless members are routed over said discharge and feed ends.

7. The structure of claim 6 wherein said flexible endless members comprise link chains, said apparatus being provided with sprocket means supportingly journaled to said tank proximate said feed and discharge ends thereof and engaging said link chains.

8. The structure of claim 6 wherein said tank includes a transverse baffle member spaced above said conveyor and proximate said discharge end.

9. The apparatus of claim 1 wherein said tank includes contiguous, separated tank portions joined by a common junction area thereof.

10. The structure of claim 9 wherein said flexible endless members proceed over said junction area.

* * * * *